United States Patent [19]

Minks

[11] 4,339,734

[45] Jul. 13, 1982

[54] ENCASED MINIATURE RELAY

[75] Inventor: Werner Minks, Kleingeschaidt, Fed. Rep. of Germany

[73] Assignee: International Standard Electric Corporation, New York, N.Y.

[21] Appl. No.: 118,013

[22] Filed: Feb. 4, 1980

[51] Int. Cl.[3] ..... H01H 51/22

[52] U.S. Cl. ..... 335/78; 335/79

[58] Field of Search ..... 335/78, 79, 80, 84, 335/85, 229, 230, 234

[56] References Cited

U.S. PATENT DOCUMENTS 3,775,715 11/1973 Bosch et al. ..... 335/230

4,064,471 12/1977 Schuessler et al. ..... 335/78 X 4,160,965 7/1979 Kobler et al. ..... 335/79

*Primary Examiner*—George Harris

*Attorney, Agent, or Firm*—John T. O'Halloran; Peter R. Ruzek

[57] ABSTRACT

Encased miniature relay comprises a magnet system with a core, a coil arranged on the core, an L-shaped yoke connected to one end to the core and an angular tilting armature which is, tiltably supported on the edge of the free end of the yoke. To obtain a holding force for the tilting armature, a permanent magnet is arranged in the free end of the magnetic path between the core and the yoke in the proximity of the arms of the armature.

12 Claims, 4 Drawing Figures

ENCASED MINIATURE RELAY

Figure 1:
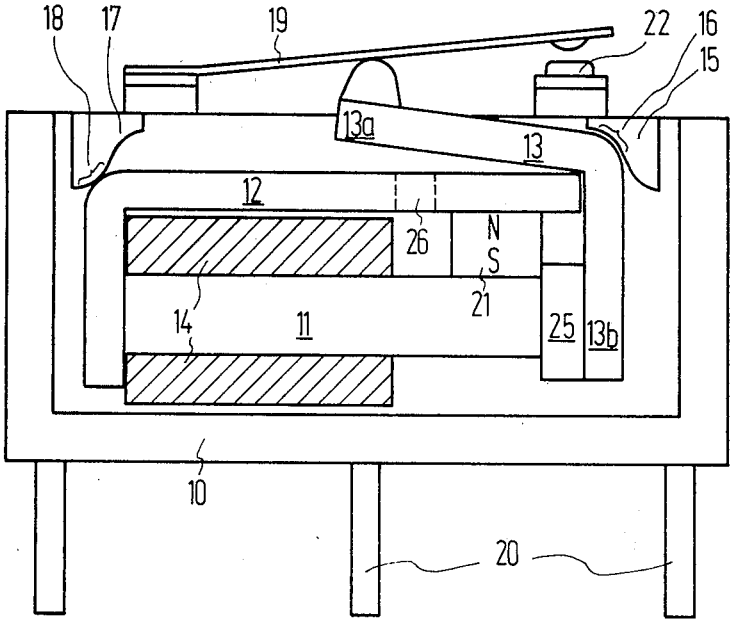

The present invention relates to an encased miniature relay comprising an angular tilting armature which is tiltably supported at its inside on the yoke of the magnet system, so that in one position the one arm of the tilting armature approaches the core and, in the other position, the other arm of the tilting armature approaches the yoke while leaving an air gap. An electric contact system is arranged on the side of the tilting armature facing away from the yoke, and is capable of being actuated by one arm of the tilting armature.

A relay of this type is disclosed in the German Pat. No. 2,516,502. This relay has a very simple design and is easy to manufacture because the parts of the magnet system inside the casing are merely held in position by shoulders moulded thereto, so that when assembling the casing, a magnet system including the angular tilting armature is automatically brought into the proper position. In the relay according to this Patent, the contact system is completely independent of the magnet system, so that both systems, inasfar as the construction and the materials election are concerned, can be designed in an optimum way for being best suited to their specific purpose of practical application, without any compromise having to be made between the electric contact function and the magnet function.

It is the object of the present invention to modify a miniature relay of this type in a simple way in such a manner that it will have bistable properties.

This objective is achieved by inserting a permanent magnet in the magnetic circuit of the magnet system.

It is known per se to use permanent magnets in the magnetic circuit of a relay for the purpose of achieving bistable properties. Thus, it has become known from the German Pat. No. 1,909,940 to arrange a ceramic magnet between the pole shoes of a relay. This conventional type of embodiment, however, involves a type of construction in which the contact system is arranged within the coil of the relay, and in which the pole shoes at the same time form the electric contacts of the contact system. Accordingly, in this case there will have to be found a compromise between the magnetic properties and the electric properties of the pole shoes.

As already pointed out in the foregoing, both the contact system and the magnet system are independent of each other in the miniature relay according to the German Pat. No. 2,516,502. As the movable part of the magnet system there is used a tilting armature which, in accordance with the necessary magnetic flux, can be dimensioned to be sufficiently thick. In the conventional relay according to the German Pat. No. 1,909,940, the armature is formed by a flexible contact reed which, to achieve its easy operability, has to be designed to be relatively thin, thus restricting the magnetic flux through the contact reed.

With the miniature relay according to the invention, the magnetic flux caused by the permanent magnet is split into two paths, i.e. to extend once via the yoke and the core back to the permanent magnet and, on the other hand, via the yoke end, one arm of the tilting armature and the end of the core back to the permanent magnet. This second path provides the holding force to be exerted by the permanent magnet upon the tilting armature for retaining the latter in a predetermined position. As a rule, the first-mentioned path extending via the yoke and the core, has the lower magnetic resistance, so that a greater magnetic flux will flow via this path. This might possibly result in a situation where the force exerted upon the tilting armature, is not sufficiently strong to hold the armature in position.

According to the further embodiment of the invention, the two magnetic fluxes are influenced in such a way as to provide a sufficient holding force for the tilting armature. This can be accomplished in that a narrow point a flow restricting portion for the magnetic flux is built into the first magnetic path. In a simple way this can be done in that the yoke is provided with an indentation or recess, thus reducing the iron cross section at this particular point which, consequently, results in an increased magnetic resistance. A lateral indentation in the yoke offers the advantage that it can be very easily made, whereas a central recess offers the advantage that the magnetic flux flowing in the yoke can be divided up symmetrically. In order to improve the magnetic flux in the second magnetic circuit, namely in the circuit including the tilting armature, the transition area at which the one arm of the tilting armature is applied to the core or to the pole shoe thereof provided with an increased cross section as compared to that of the remainder of the core, i.e., the magnetic resistance is reduced at this particular area.

By taking these measures it can be easily accomplished that the magnetic flux generated by the permanent magnet, which is determinative of the holding force of the tilting armature, will become sufficiently strong.

Figure 2:
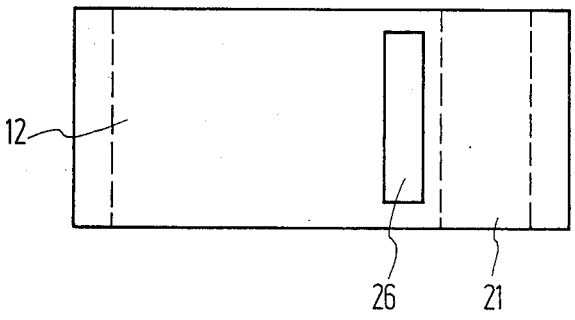
Figure 3:
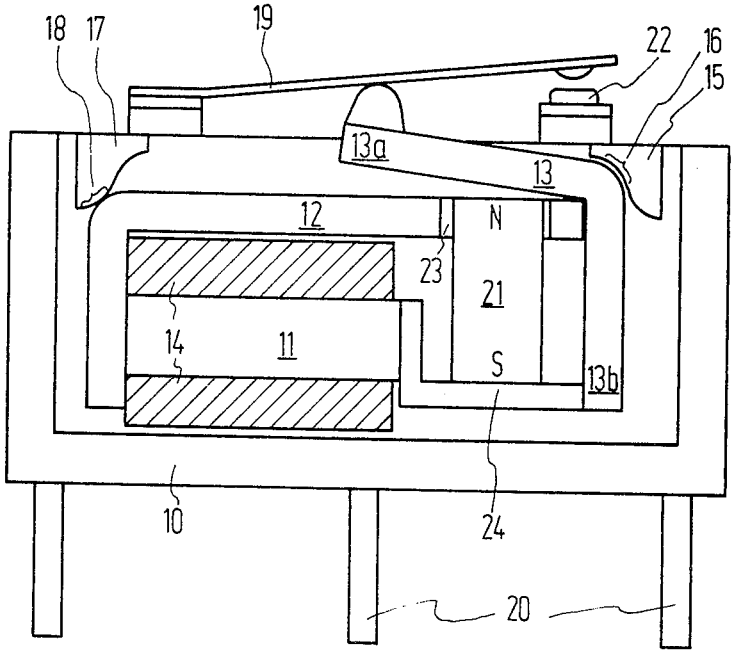
Figure 4:
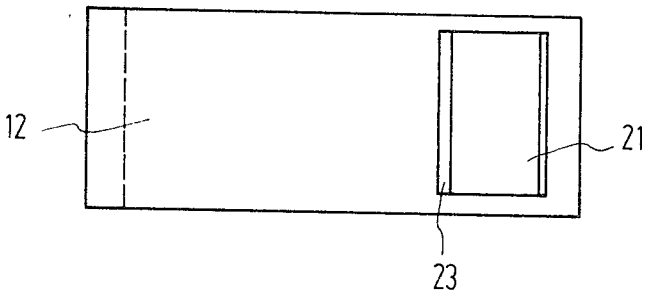

The invention as well as further advantageous embodiments thereof, will now be explained in greater detail with reference to FIGS. 1 to 4 of the accompanying drawings, in which:

FIG. 1 is a section taken through a miniature relay according to the invention, FIG. 2 is a top plan view of the yoke of the relay shown in FIG. 1, FIG. 3 is a section taken through another type of embodiment of the relay according to the invention, and FIG. 4 is a top plan view of the yoke of the relay according to FIG. 3.

The magnet system of the relay which is shown in a sectional view in FIG. 1, is arranged inside a casing 10 to which the contact pins 20 are moulded. The magnet system itself consists of the core 11 and of the yoke 12, with a coil 14 being arranged on the core 11. The angular tilting armature 13 is tiltably supported on the edge of the arm of the yoke 12 which is arranged above the coil. The contact spring 19 co-operating with the fixed contact 22 is actuated by the arm 13*a* of the tilting armature 13. The contact arrangement is only shown schematically and may equally well also consist of a larger number of contacts. The parts of the magnet system are retained inside the casing 10 via the shoulders 15 and 17 with the shoulder member 16 retaining the tilting armature 13 in its position while the shoulder member 18 serves to secure the yoke 12 together with the core 11 and the coil 14 in their positions.

For achieving bistable properties, the permanent magnet 21 is arranged in the magnetic circuit between the yoke 12 and the core 11, with this permanent magnet 21 being polarized in the longitudinal direction. In the type of embodiment according to FIG. 1, the permanent magnet 21 is arranged between an extension of the core 11 which is projected out of the coil 14 and the bottom side of the yoke 12.

When electric current flows through the coil 14, there is produced a magnetic field which is superposed the magnetic flux of the permanent magnet 21. By this it is effected that the angular tilting armature 13 is permitted to tilt into the respective other position. In both positions the tilting armature 13 is retained by the permanent magnet 21 in that either the arm 13*a* is attracted to the yoke 12 or the arm 13*b* is attracted to the end of the core 11.

For an improved dividing up of the magnetic flux between the two magnetic circuits, a recess 26 is provided for in the yoke 12 as can be seen, in particular, from FIG. 2. Owing to this recess 26 the iron cross section of the yoke 12 is reduced at this particular point, thus increasing the magnetic resistance. In this way it is achieved that a larger portion of the magnetic flux of the permanent magnet becomes available for retaining the tilting armature B.

For further improving the magnetic flux flowing via the tilting armature 13, the cross section of the core 11 is enlarged at its end, e.g., by inserting a pole shoe 25. By this, the magnetic resistance between the core 11 and the arm 13*b* of the tilting armature is reduced, so that also in this way there is achieved a better magnetic flux in this circuit.

As is evident from FIG. 2, the permanent magnet 21 is applied throughout its entire width to the yoke 12. Instead of the recess 26, there may also be provided a lateral indentation in the yoke 12 which, on one hand, can be easier manufactured than the recess 26 but which, on the other hand, effects an asymmetrical magnetic flux via the cross section of the yoke 12.

In the embodiment shown in FIG. 3, the permanent magnet 21 is arranged with one pole on one pole shoe 24 constituting an extension of the core 11. This pole shoe or core extension 24 is of L-shaped design, thus permitting the use of a permanent magnet 21 with larger dimensions. If, however, there is used a pole shoe 24 of U-shaped cross section, there will be obtained an improved transition of the magnetic flux to the arm 13*b* of the tilting armature 13, i.e. in a similar way as is achieved by the pole shoe 25 in FIG. 1.

Moreover, in embodiment shown in FIG. 3, the yoke 12 is provided with a cutout 23 into which one pole of the permanent magnet 21 projects. This results in a particularly good transition of the magnetic flux from the permanent magnet 21 to the yoke 12, and in a further enlargement of the permanent magnet 21. The yoke cutout 23 may simultaneously be used for reducing the magnetic flux in the yoke 12, by dimensioning it larger than the permanent magnet 21 projecting therein, and by arranging the permanent magnet 21 eccentrically within the cutout 23, as is shown in FIG. 4.

For the purpose of achieving defined return-to-zero properties, the angular tilting armature 13 may additionally be acted upon by a weak spring which, e.g., may be realized in the form of a foil which is connected to one arm of the tilting armature B.

I claim:

1. Encased bistable miniature relay comprising an electric switching element movable between two end positions; means for selectively moving said switching element between said end postions, including an electrically energizable coil having an internal passage, a core partially received in said passage and having an extension projecting out of said passage, a yoke connected to said core and having an end portion substantially coextensive with said extension at a spacing therefrom, an armature having a first and a second arm which extend at an obtuse angle relative to one another to delimit a corner region therebetween, and means for mounting said armature so that said extension and said end portion are situated in and said switching element is situated across one of said arms from said corner region, and for angular displacement between a first position in which said first arm is proximate to and bridges the spacing between said extension and said end portion and a second position in which said second arm is proximate to said end portion, said one arm acting on said switching element to move the same toward one of said end positions thereof as said armature is displaced from one to the other of said positions thereof; and means for holding said armature in the then assumed position thereof in the absence of energization of said coil, including a permanent magnet extending across said spacing between said extension and said end portion and generating a magnetic flux through said extension, said end portion and said armature which attracts said first arm to said extension in said first position of said armature and said second arm to said end portion in said second position of said armature.

2. The relay as defined in claim 1, wherein said yoke has a flux-restricting portion between said end portion and the remainder of said yoke.

3. The relay as defined in claim 2, wherein said flux-restricting portion has a lateral indentation therein.

4. The relay as defined in claim 2, wherein said flux-restricting portion has a substantially centrally located recess therein.

5. The relay as defined in claim 4, wherein said permanent magnet has two end portions one of which is received in said recess.

6. The relay as defined in claim 5, wherein said one end portion of said permanent magnet is eccentrically received in said recess.

7. The relay as defined in claim 1, wherein said extension is an integral part of said core.

8. The relay as defined in claim 1, wherein said extension is constituted by a pole shoe separate from and attached to the remainder of said core.

9. The relay as defined in claim 8, wherein said pole shoe has an L-shaped configuration.

10. The relay as defined in claim 8, wherein said pole shoe has a U-shaped configuration.

11. The relay as defined in claim 1, wherein said extension of said core has an enlarged magnetically effective cross-sectional area at the region of juxtaposition with said first arm of said armature as compared to that of the remainder of said core.

12. The relay as defined in claim 11, wherein said core extension is constituted by a pole shoe which is attached to the remainder of the core and has said enlarged magnetically effective cross-sectional area.

* * * * *